US005984700A

United States Patent [19]

Chang

[11] Patent Number: 5,984,700

[45] Date of Patent: Nov. 16, 1999

[54] SAFETY RECEPTACLE

[76] Inventor: Chi Tsai Chang, P.O. Box 82-144, Taipei, Taiwan

[21] Appl. No.: 08/898,010

[22] Filed: Jul. 25, 1997

[51] Int. Cl.[6] ..... H01R 13/44

[52] U.S. Cl. ..... 439/139; 439/188; 439/346

[58] Field of Search ..... 439/139, 143, 439/188, 346

[56] References Cited

U.S. PATENT DOCUMENTS 5,429,518 7/1995 Chen ..... 439/188

5,795,168 2/1996 Duhe ..... 439/188

*Primary Examiner*—Steven L. Stephen

*Assistant Examiner*—Javald Nasri

*Attorney, Agent, or Firm*—A & J

[57] ABSTRACT

A safety receptacle includes a base (10) formed with a circular depression (11) and two opposite cavities (18) one at a side of the depression, two conducting members (19) each fitted into a respective one of the cavities of the base, a rotary head (20) being a tubular member formed with a top having two parallel slots (20), a pair of opposite flanges (24) extending outwardly from two opposite sides of the tubular member, a block (28) depending downwardly from a central portion of a lower side of the top, and two vertical slots at two opposite sides of the tubular member, a positioning member (17) having an upper end fixedly fitted in the block of the rotary head and a lower end engaged with the recess, two terminals (22) each inserted into a respective one of the vertical slots along the two legs and provided with an inwardly extending tongue (221) , and a cover (30) fixedly mounted on the base and having a circular opening for receiving the top of the rotary head, whereby rotation of the plug (40) through 90 degrees causes movement of terminals (22) into engagement with conducting members (19) and movement of pin (141) into a hole in blade (41) to lock the plug in position thereby making the receptacle unable to conduct electricity until a predetermined operation has been performed.

3 Claims, 4 Drawing Sheets

SAFETY RECEPTACLE

BACKGROUND OF THE INVENTION

1. Field of the Invention

This invention is related to an improved safety receptacle and in particular to one which will not conduct electricity until a predetermined operation has been performed.

2. Description of the Prior Art

The numerous hazards presented by conventional electrical receptacles are well known and documented. This is because children, emboldened by curiosity, may attempt to insert metal objects such as hairpins or nail files into the slots in the front face of the receptacle. Should the child thereby contact the line side of the outlte, he may receive a serious, even a fatal shock. Various safety receptacles have been devised to rectify these problems. However, all of the attempts heretofore made have resulted in devices having certain drawbacks. One approach which has been taken in several prior art devices involves the addition of a sliding plate, either to the cover or to the receptacle itself. The sliding plate is provided with slots for receiving the male blades of an electrical cap. These slots are normally non-aligned with the receptacle slots and a double motion is required to insert the cap. Hence, the user is required to perform a double movement in order to insert the cap, thereby making it difficult to perform under conditions of low illumination. The other drawback is that a child could accidentally or purposely uncover both slots with a single instrument.

Therefore, it is an object of the present invention to provide an improved safety receptacle which can obviate and mitigate the above-mentioned drawbacks.

SUMMARY OF THE INVENTION

This invention is related to an improved safety receptacle and in particular to one which will not conduct electricity until a predetermined operation has been performed.

It is the primary object of the present invention to provide an improved safety receptacle where insertion of a metal object will cause no damage to the person inserting it.

It is still another object of the present invention to provide an improved safety receptacle which can prevent an electrical plug from disengaging therefrom inadvertently.

It is still another object of the present invention to provide an improved safety receptacle which can guard against the possibility of electrical shock.

It is still another object of the present invention to provide an improved safety receptacle which is simple to use and inexpensive to manufacture.

It is a further object of the present invention to provide an improved safety receptacle which is fit for practical use.

The foregoing objects and summary provide only a brief introduction to the present invention. To fully appreciate these and other objects of the present invention as well as as the invention itself, all of which will become apparent to those skilled in the art, the following detailed description of the invention and the claims should be read in conjunction with the accompanying drawings. Throughout the specification and drawings identical reference numberals refer to identical or similar parts.

DETAILED DESCRIPTION OF THE PREFERRED EMBODIMENT

Figure 1:
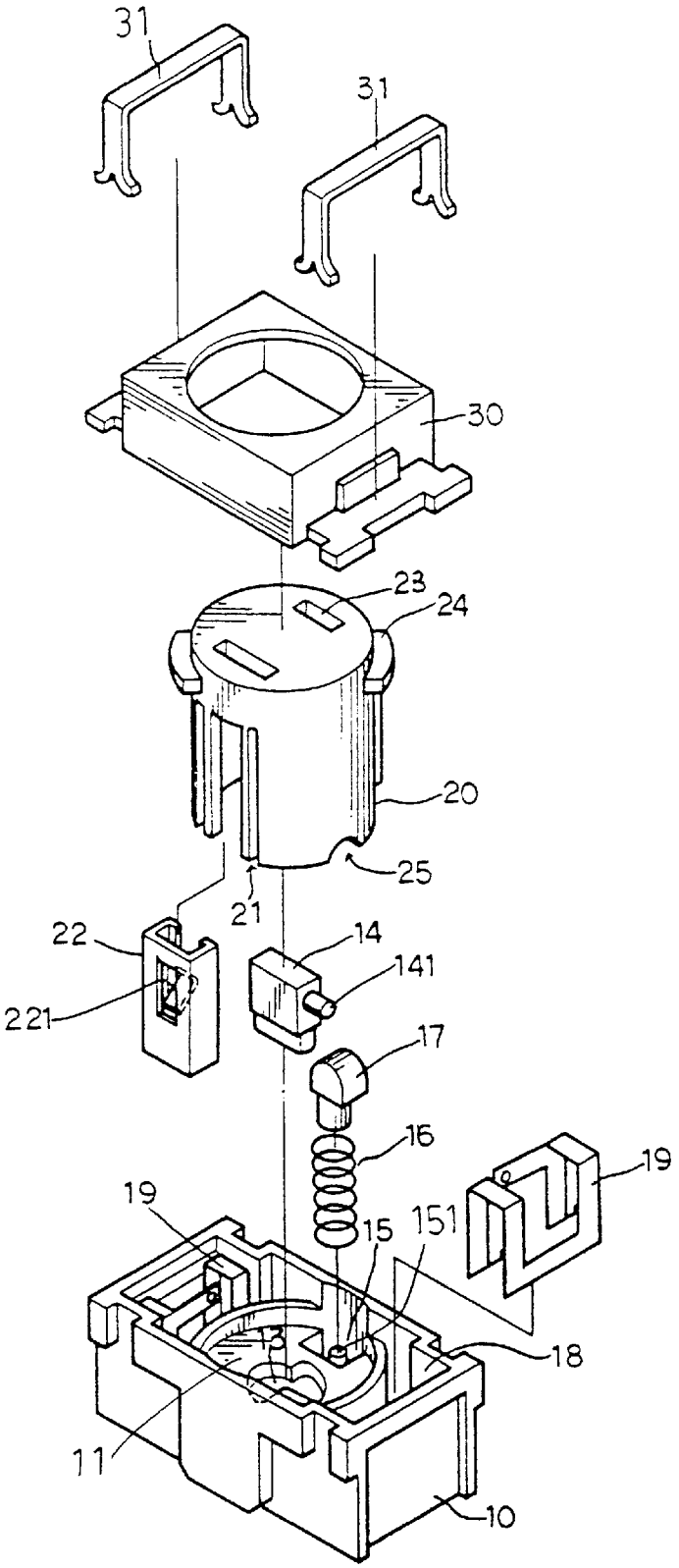
FIG. 1 is an exploded view of a safety receptacle according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
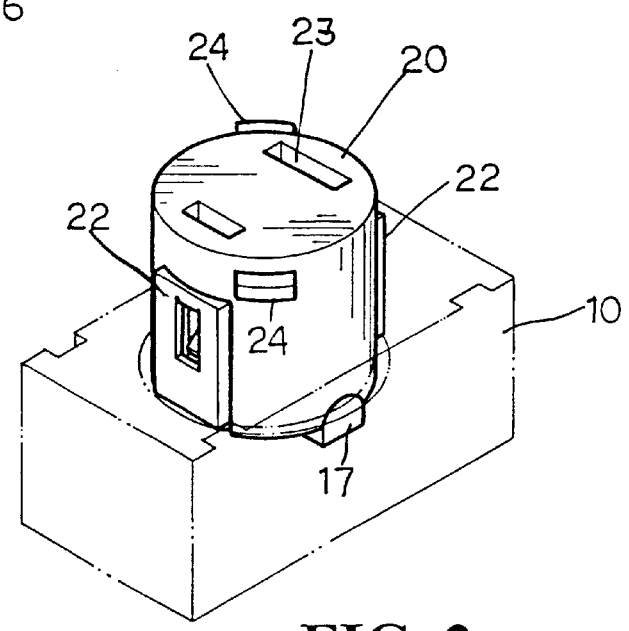
FIG. 2 is a perspective view of the saftey receptacle, with the rotary head rotated through an angle of 90 degrees with respect to the base.

With reference to the drawings and in particular to FIGS. 1 and 2 thereof, the safety receptacle according to the present invention generally comprises a base 10, a rotary head 20 and a cover 30.

The base 10 is a rectangular member formed with a circular depression 11 and two opposite cavities 18, one at a side of the depression 11. The circular depression 11 has a recess 13 at the central portion and a vertical blind hole 15 at one side of the recess 13 and between the two cavities 18. The blind hole 15 is formed with a vertical rod member 151 at its central portion. The circular depression 11 is designed for receiving the bottom of the rotary head 20. Each of the cavities 18 is used for accommodating a conducting member 19. A spring 16 is fitted within the blind hole 15 and a positioning member 17 with a circular top is arranged on the spring 16 and vertically slidably engaged with the vertical rod member 151.

Figure 5:
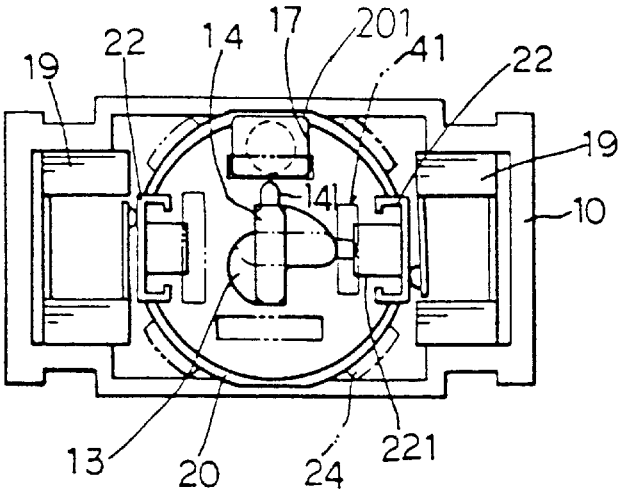
FIGS. 4 and 5 illustrate the working principle of the safety receptacle.

The rotary head 20 is a tubular member formed with a top having two parallel slots 23, a pair of opposite flanges 24 extending outwardly from two opposite sides of the tubular member, a circular notch 25 at the bottom adapted to receive the top of the positioning member 17, a vertical groove 201 (see FIG. 5) at the inner surface of the tubular member for receiving the upper portion of the positioning member 17, a block 28 (see FIG. 3) depending downwardly from the central portion of the lower side of the top, and two vertical slots 200 at two opposite sides of the tubular member. One of the parallel slots 23 is aligned with the positioning member 17. At both sides of the vertical slots 200 there is a guiding groove 21 and a leg 300 depending downwardly from the top of the rotary head 20. A terminal 22 is inserted along the two guiding the rotary head 20 with its outer side contacting a respective conducting member 19. The terminal 22 is provided with a tongue 221 extending inwardly from an outer side of the terminal 22. In the recess 13 is fitted the lower end of a fixing member 14 which has a horizontally extending pin 141 for inserting into a hole of a blade of an electrical plug (see FIG. 4). The upper end of the fixing member 14 is fixedly engaged with the block 28 of the rotary head 20.

The cover 30 is fixedly mounted on the base 10 and has a circular opening for receiving the top of the rotary head 20 by two clamps 31. The flanges 24 of the rotary head 20 is used for preventing the rotary head 20 from getting out of the cover 30.

Figure 3:
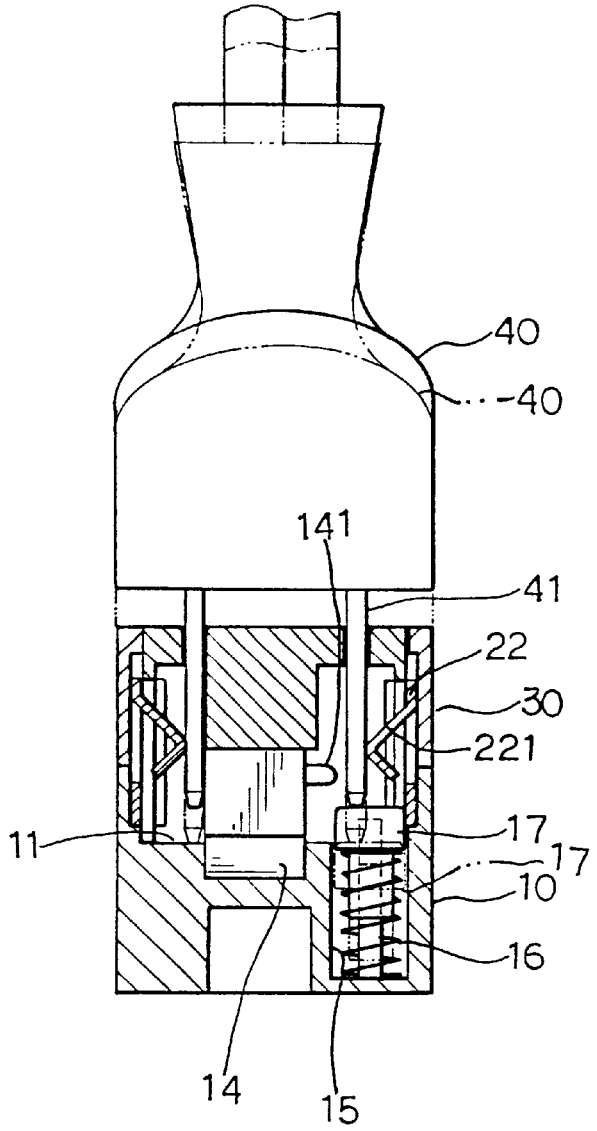
FIG. 3 is a sectional view illustrating the connection between the safety receptacle and an electrical plug.
Figure 4:
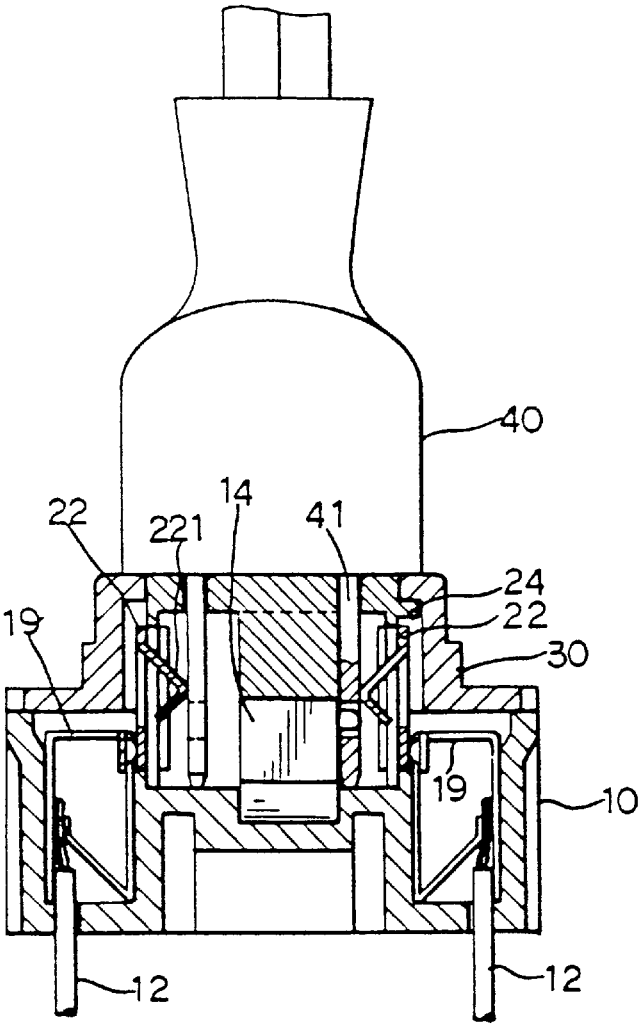

When in use, the blades 41 of an electrical plug 40 are first inserted into the slots 23 of the rotary head 20 until the lower end of one of the blades 41 is in contact with the top of the positioning member 17, and then the electrical plug 40 is further pushed into the rotary head 20 to press the positioning member 17 away from the rotary head 20 (see FIG. 3). Meanwhile, the blades 41 of the electrical plug 40 are engaged with the tongues 221 of the terminals 22. Thereafter, the rotary head 20 is turned through an angle of 90 degrees counterclockwise (with respect to FIG. 1) so that the terminals 22 are in contact with the conductors 19. In the meantime, the fixing member 14 is rotated along the recess 13 through an angle of 90 degrees so that the protuberance 141 of the fixing member 14 is fitted into the hole of the corresponding blade 41 of the electrical plug 40 thereby preventing the electrical plug 40 from disengaging from the electrical receptacle according to the present invention when in use (see FIGS. 4 and 5). Furthermore, the positioning member 17 is no longer pressed by the blade 41 of the electrical plug 40 and goes upwardly to engage the circular notch 25 of the rotary head 20 hence further keeping the electrical plug 40 in place (see FIG. 2).

Figure 6:
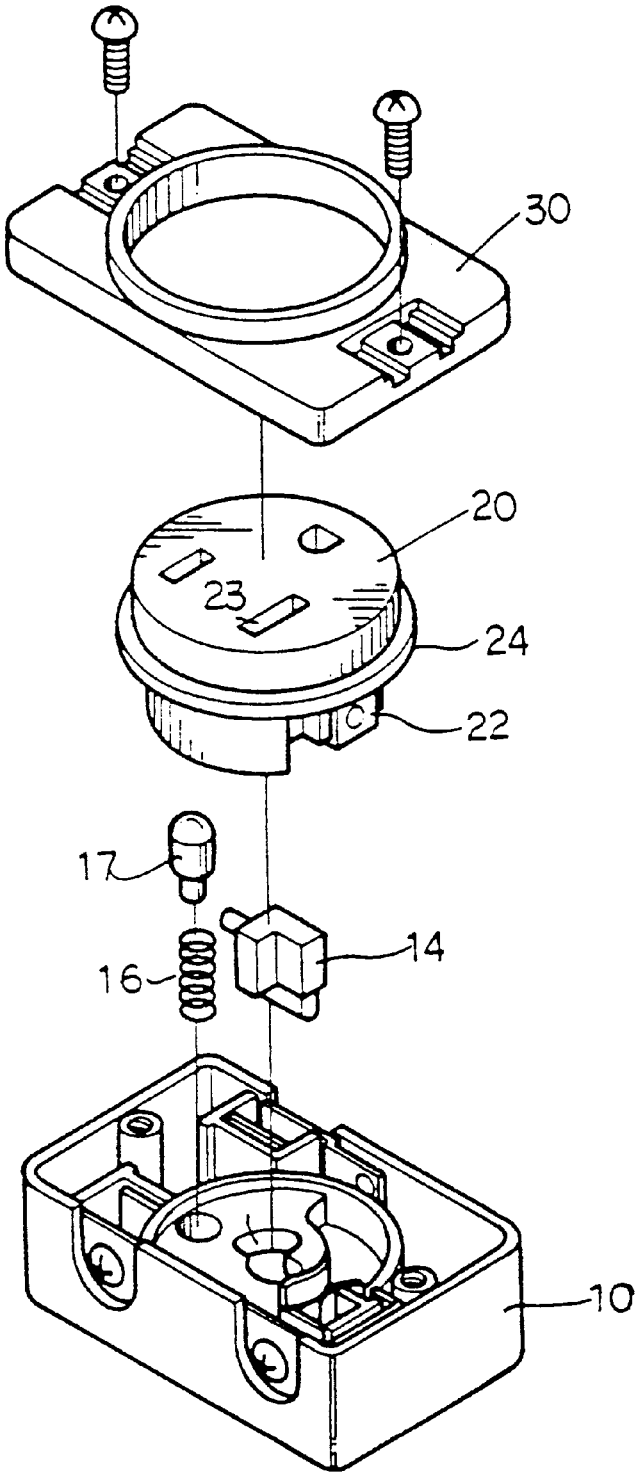
FIG. 6 is an exploded view of another preferred saftety receptacle according to the present invention.

As shown in FIG. 6, the present invention is also applicable to a three-slot receptacle, wherein the positioning member 14 is a L-shaped member and the rotary head 20 has a circular flange 24.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A safety receptacle comprising:

a base formed with a circular depression and two opposite cavities one at a side of said depression, said circular depression having a recess;

two conducting members each fitted into a respective one of said cavities of said base;

a rotary head being a tubular member formed with a top having two parallel slots, a pair of opposite flanges extending outwardly from two opposite sides of said tubular member, a block depending downwardly from a central portion of a lower side of said top, and two vertical slots at two opposite sides of said tubular member, each of said vertical slots being provided with two legs depending downwardly from said top;

a fixing member having an upper end fixedly fitted in said block of said rotary head and a lower end engaged with said recess, said fixing member having a horizontally extending pin adapted to be inserted into a hole of a blade of an electrical plug;

two terminals each inserted into a respective one of said vertical slots along said two legs and provided with an inwardly extending tongue; and a cover fixedly mounted on said base and having a circular opening for receiving said top of said rotary head.

2. The safety receptacle as claimed in claim 1, wherein said circular depression is formed with a blind hole in which are fitted a spring and a positioning member on said spring, said blind hole being aligned with one of said parallel slots of said rotary head, said positioning member having a circular top, said spring urging said positioning member to go upwardly to engage with a vertical groove in an inner surface of said rotary head.

3. The safety receptacle as claimed in claim 2, wherein said rotary head has a bottom formed with a circular notch engageable with said circular top of said positioning member.

* * * * *